US008388210B2

(12) United States Patent
Paterson

(10) Patent No.: US 8,388,210 B2
(45) Date of Patent: Mar. 5, 2013

(54) WALLS

(75) Inventor: John Paterson, Strathclyde (GB)

(73) Assignee: Westcrowns Contracting Services Limited, Glasgow (GB)

( * ) Notice: Subject to any disclaimer, the term of this patent is extended or adjusted under 35 U.S.C. 154(b) by 305 days.

(21) Appl. No.: 12/278,793

(22) PCT Filed: Feb. 7, 2007

(86) PCT No.: PCT/GB2007/050052

§ 371 (c)(1),
(2), (4) Date: Aug. 8, 2008

(87) PCT Pub. No.: WO2007/091104

PCT Pub. Date: Aug. 16, 2007

(65) Prior Publication Data

US 2010/0165606 A1 Jul. 1, 2010

(30) Foreign Application Priority Data

Feb. 10, 2006 (GB) ..... 0602679.3

(51) Int. Cl.
*F21V 7/04* (2006.01)

(52) U.S. Cl. ..... 362/633; 362/632; 362/634

(58) Field of Classification Search ..... 362/600–634
See application file for complete search history.

(56) References Cited

U.S. PATENT DOCUMENTS

| | | | | |
|---|---|---|---|---|
| 3,101,572 | A * | 8/1963 | Stenger | 52/394 |
| 4,637,148 | A * | 1/1987 | Barlow | 40/1.5 |
| 5,045,755 | A * | 9/1991 | Appelberg | 313/498 |
| 7,140,763 | B1 * | 11/2006 | Keith-Wolfe | 362/628 |
| 2002/0195931 | A1 | 12/2002 | George et al. | |
| 2003/0035283 | A1 * | 2/2003 | Lim | 362/240 |
| 2003/0179566 | A1 * | 9/2003 | Ito | 362/330 |
| 2003/0189823 | A1 * | 10/2003 | George et al. | 362/84 |
| 2004/0031234 | A1 | 2/2004 | Emde | |
| 2004/0128932 | A1 | 7/2004 | Estape | |
| 2006/0077686 | A1 * | 4/2006 | Han et al. | 362/610 |

FOREIGN PATENT DOCUMENTS

| | | | |
|---|---|---|---|
| DE | 4300819 | A1 | 7/1994 |
| DE | 202004005078 | U1 | 9/2004 |
| EP | 0438110 | A1 | 7/1991 |
| GB | 1118992 | A | 7/1968 |
| GB | 1527271 | A | 10/1978 |
| WO | 2007 091104 | A1 | 9/2007 |

OTHER PUBLICATIONS

International Search Report corresponding to PCT/GB2007/050052, dated Jul. 5, 2007.

The International Search Report for PCT/GB2007/050052, dated Apr. 26, 2007.

European Search Report for corresponding Europoean application No. 07705365.0, mailed on Feb. 24, 2011.

* cited by examiner

*Primary Examiner* — William Carter
(74) *Attorney, Agent, or Firm* — Buchanan Nipper

(57) ABSTRACT

A glass or plastic wall structure with nested channel members is provided with electroluminescent strips running along the channel flanges to provide an internal illumination. In particular, it relates to illuminated transparent walls or internal partitions of a building or similar fixed construction.

26 Claims, 4 Drawing Sheets

WALLS

CROSS REFERENCE TO RELATED APPLICATIONS

This application is a national stage filing under section 371 of International Application No. PCT/GB2007/050052, filed on Feb. 7, 2007, and published in English on Aug. 16, 2007 as WO 2007/091104 and claims priority of Great Britain application No. 0602679.3 filed on Feb. 10, 2006, the entire disclosure of these applications being hereby incorporated herein by reference.

TECHNICAL FIELD

The present invention relates to improvements in or relating to walls, in particular to illuminated transparent or translucent walls.

BACKGROUND OF THE INVENTION

A "wall" in this context is taken to mean a wall of a building or similar fixed construction, either internal or external. The term also encompasses internal partitions for a building, which may extend only part way between the floor and ceiling of a room in a building.

There are a number of different construction materials available for the formation of a building's walls. One material, which can be chosen, is glass. Its light transmission properties can create a spacious light and airy aspect within a building.

Because of the transparency of glass, it is known to provide illumination to further improve the appearance of a building or to increase its visibility. However, this requires the installation of separate illumination apparatus, which must be separately installed and powered and arranged close to the wall.

BRIEF SUMMARY OF INVENTION

According to a first aspect of the present invention there is provided a transparent or translucent wall comprising internal illumination means.

According to a second aspect of the invention there is provided a transparent or translucent wall component that comprises illumination means.

Preferably, the wall is formed from a glass or plastic material.

Preferably, the wall comprises a plurality of nested channel members.

Preferably, the illumination means is provided at a side flange of at least one channel member.

Preferably, the illumination means comprises an electroluminescent strip.

Preferably, the electroluminescent strip is adhesively bonded to the channel flange.

Preferably, the electroluminescent strip has a split electrode structure.

Alternatively, the electroluminescent strip has a parallel electrode structure.

Preferably, the illumination means comprises one or more light emitting diodes (LED's).

Preferably, a DC-AC inverter is provided to power the illumination means.

Preferably, the wall comprises an upper housing member and a lower housing member for receiving the channel members.

Preferably, the upper and/or lower housing members comprises power connection means for the illumination means.

Preferably, a frame member is provided for housing the upper and lower housing members and the wall structure.

According to a third aspect of the invention there is provided a building comprising a wall structure according to the first aspect.

BRIEF DESCRIPTION OF THE DRAWING FIGURES

The present invention will now be described, by way of example only, with reference to the accompanying drawings, in which.

DETAILED DESCRIPTION

One particular type of currently available profiled glass wall system is the U channel glass wall system. Within this system, translucent cast glass U channels are fitted into an extruded metal perimeter frame and are fixed in place by the use of a silicone sealant.

The channels can be installed either vertically or horizontally and are supplied in a variety of colours and textures with varying translucency. The system can be single glazed or dual glazed, and can be used to form walls of any chosen profile or curvature.

Figure 1:
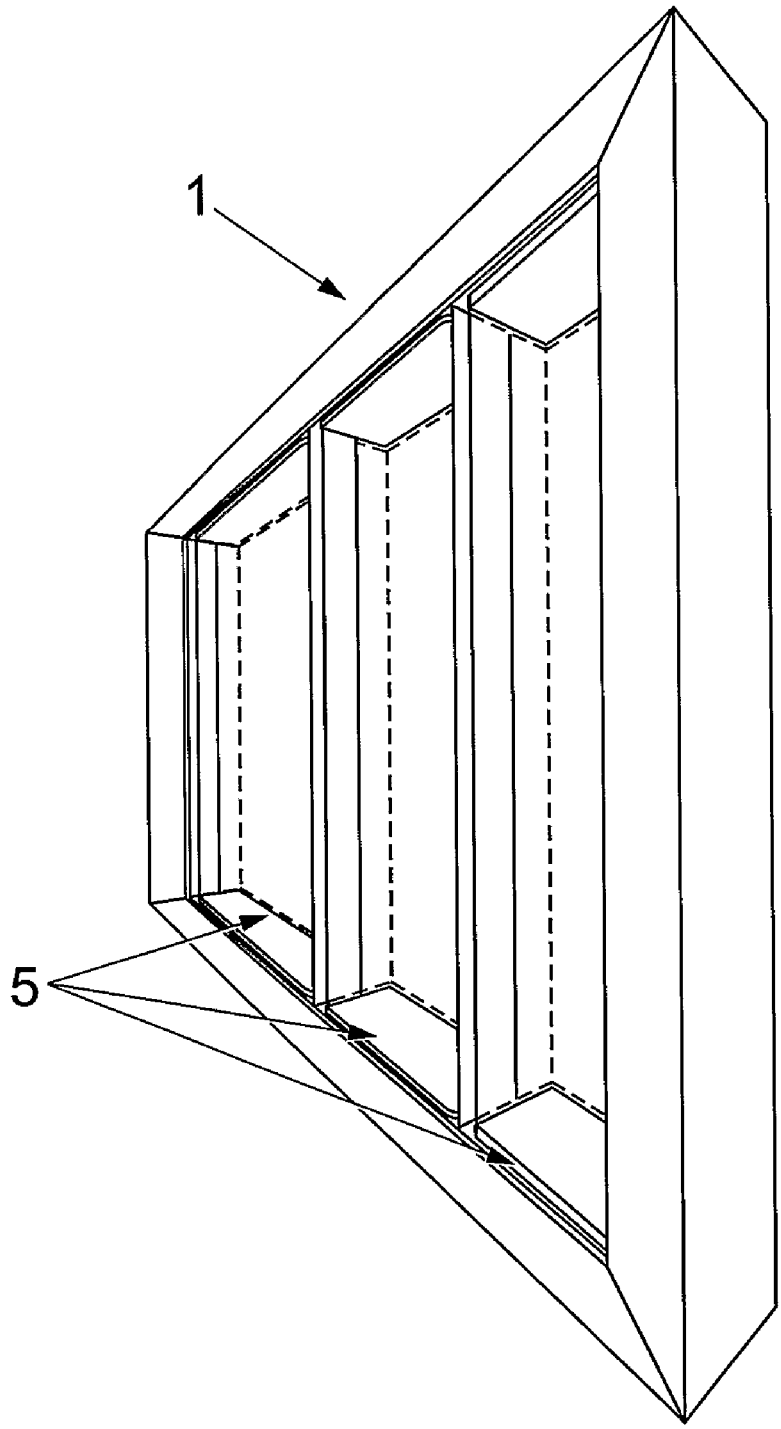
FIG. 1 shows an exploded view of a wall according to the first embodiment of the invention.

In the first embodiment of the present invention a wall structure comprises a plurality of interlocking channel members and an electroluminescent strip is provided along the edges of the channels. FIG. 1 shows a specific implementation of this embodiment with a profiled glass wall system, specifically, the U-channel system previously identified. A number of panels (5) are enclosed within the frame (1).

Figure 2:
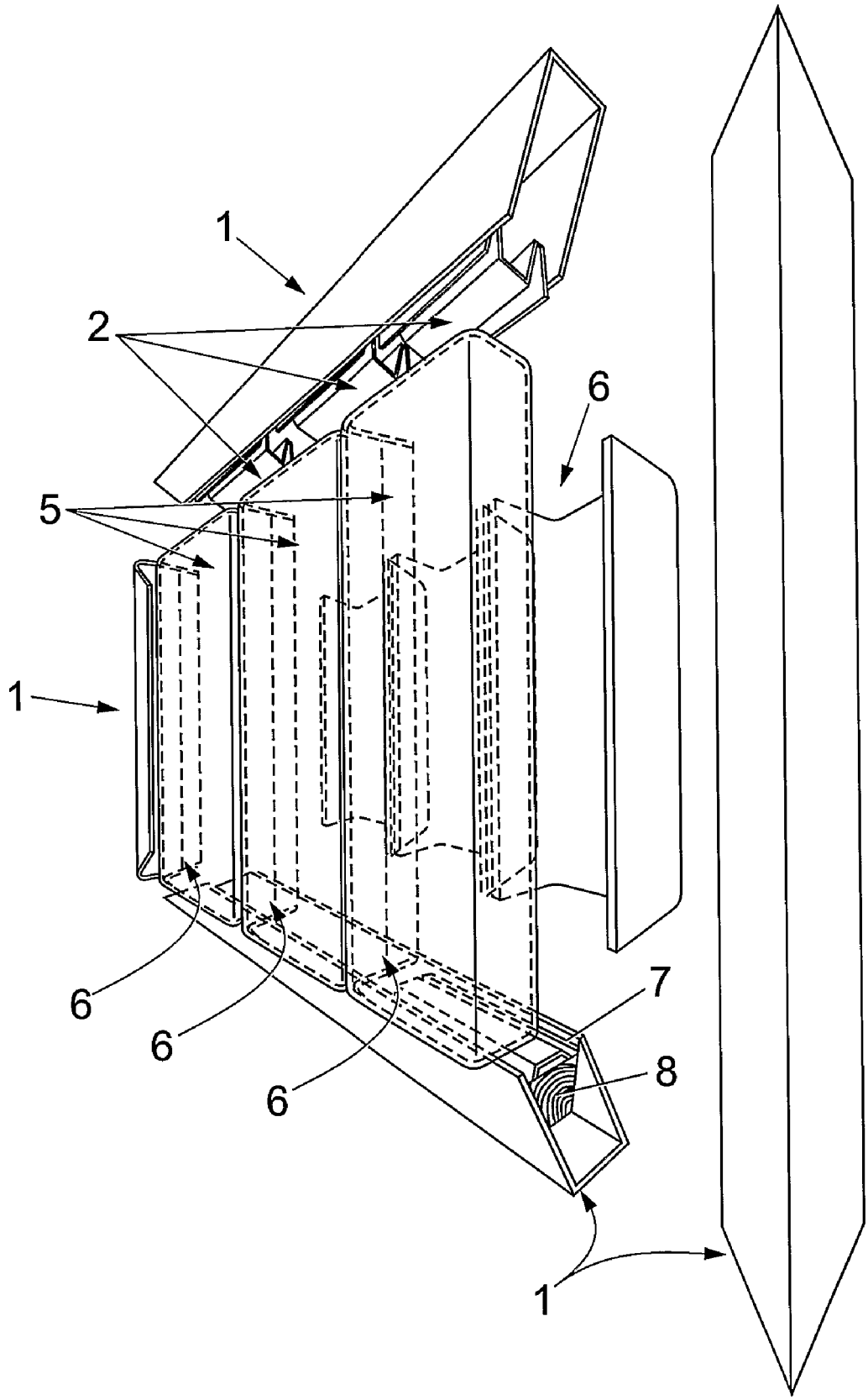
FIG. 2 shows an exploded view of how the wall of FIG. 1 is assembled to include the illumination mean.

An exploded view is shown in FIG. 2. The glass wall system comprises a plurality of panels (5), which are formed in a nested channel formation, and an electroluminescent strip (6) is provided at the sides of the channels. The pieces (5) are held between a lower plastic insert (7) and a top plastic insert (2) which comprises holes for housing the power connectors (3) for the electroluminescent strip (6). A packing material (8) and frame (1) completes the system.

As seen in FIG. 2, a plurality of outward facing channels (with flanges pointing into the page) are placed side-by-side, with a plurality of inward facing channels (with flanges pointing out of the page) providing a nested interlock.

Figure 3:
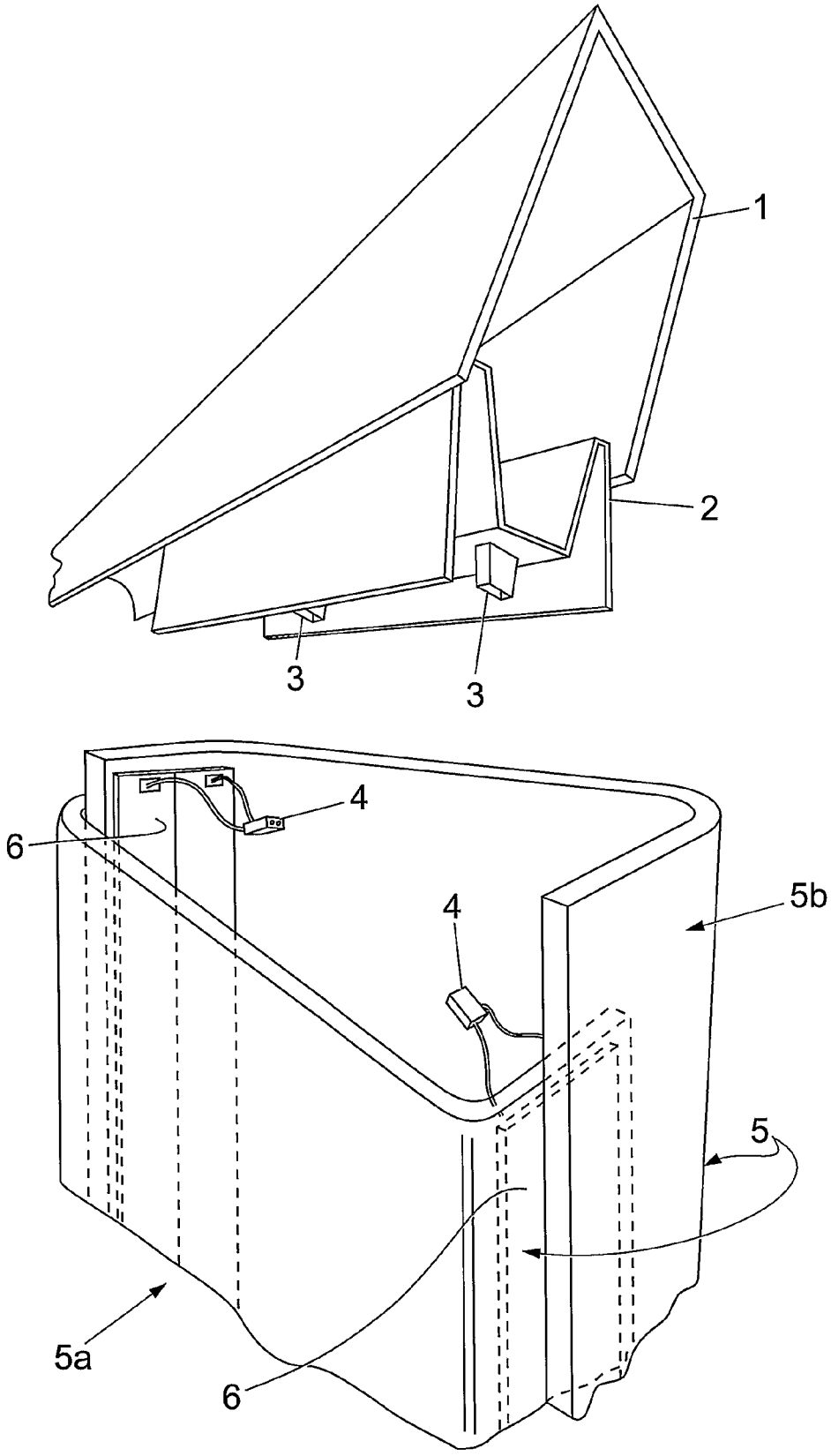
FIG. 3 shows the arrangement of the first embodiment.
Figure 4:
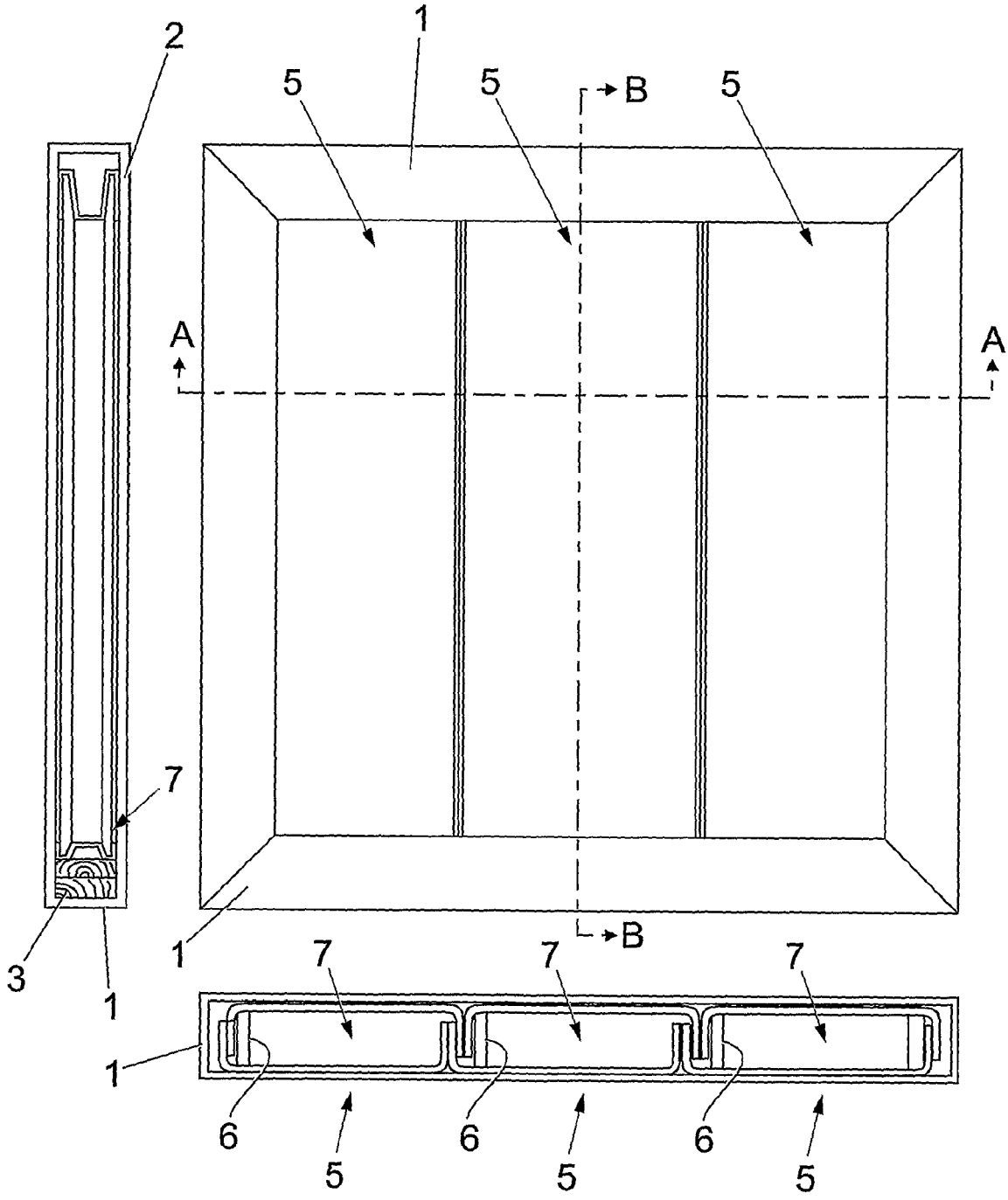
FIG. 4 shows an orthographic view of the wall in FIG. 1 containing a sectional view showing the means of illumination.

FIG. 3 shows the incorporation of the electroluminescent strips (6) on the channels (5). An outward facing channel (5*a*) has an electroluminescent strip (6) adhesively bonded to the inner edge of its right hand flange, while the inward facing channel (5*b*) has an electroluminescent strip (6) adhesively bonded to the inner edge of its left hand flange. Thus, the space enclosed by the two interlocked channels (5) is directly illuminated by the electroluminescent strips (6).

Female power connectors (3) are provided on a flange of the top plastic insert (2) for connection with the male power connectors (4) at the top of each electroluminescent strip (6).

In one embodiment a single strip is provided which has connectors in another embodiment each vertical channel has a connector provided at the top of each strip (6) provided thereon. A wiring loom (not shown) is provided which runs through the frame (1), for providing power to the electroluminescent strip (6) by means of an Inverter (not Shown).

The scope of the invention is not limited to any particular type of illumination. However, the use of an electroluminescent strip is advantageous. An incandescent lamp or a tungsten lamp has a very low energy efficiency—approximately 85% of the energy is given off as heat, and they also have a short lifetime—approximately 1000 hours. Halogen bulbs are an improvement but still provide relatively high heat losses and have a relatively short lifetime.

Fluorescent lamps are 4 to 5 times more efficient than tungsten lamps and have an improved lifetime of up to 10,000 hours. However, for the current application the required area of the electrodes combined with the transformer used to run the lamps is excessively large does not make them an attractive option, and there are also environmental issues to do with safe disposal of the mercury used in the lamps.

Light emitting diodes (LED's) have a long lifetime and low power requirement, but because they act as point sources of light, generating a specific light pattern that is not always desirable.

An electroluminescent light, also known as a light emitting capacitor (LEC) produces light when phosphor crystals are excited by being exposed to an AC electric current. Electroluminescent panels and strips can be found as back lighting for LCD's in pagers, cell phones, watches and control panels as well as strip lighting for egress decor architecture, broadcast sets and others.

Because no filament is included, the strips have a very long life, are flexible, cool to the touch and highly visible in darkness, smoke and fog etc. The strips also have a very low energy consumption, contain few hazardous materials and require no maintenance.

Electroluminescent film is powered either by parallel electrodes or split electrodes. An electroluminescent lamp comprises a phosphor layer interposed between a clear conductive ITO layer and a rear electrode. In a parallel plate electroluminescent lamp, voltage is applied between the top ITO layer and the rear electrode whereas in a split electroluminescent lamp, a split is made in the rear electrode and a voltage is applied across the two created sides of the electrode.

A power inverter is provided to convert DC power or direct current to standard AC power or alternating current. A compensating inverter can maximise a lamp life by maintaining a variable output as the lamp goes through the normal ageing process.

Other power sources can also be used with a limiting resistor to step down the power of a transformer to step it up as in the case of using a low power amplifier.

Electroluminescent film comes in ten basic colours but some colours will vary depending on the frequency used to power them. Another method of colouring the lamps are by the use of gels, these are simply coloured plastic films. Different colours can be spliced together with wire cutters.

Since in the present embodiment the film runs on a parallel circuit it only needs to be properly terminated when trimmed. This can be accomplished by using super glue, epoxy or other types of sealers to protect the film from moisture. After a period of time the electroluminescent film will become dimmer. This happens more quickly when powered by a higher voltage and or frequency.

The wall structure of the present invention can incorporate other features of known glass walls to give specific optical characteristics such as a different opacities for different light transmission level or different diffuseness of light, acoustic properties giving sound insulation up to appropriate levels or thermal insulation for example giving double glazing or having special coatings on the glass, such as hard pyrolytic surface coatings. The pyrolytic coating creates a very slight coat sheen coat to the glass but does not affect the intrinsic colour of the glass channels. Also, specialised glass types with a solar control coating to reduce the amount of solar energy transmitted through the glazing can be provided.

Connections to the electroluminescent lamp can be flexible printed circuits solderable metal strip, contact pads, solder pads, or other customised designs according to a customer's individual requirements.

The inverter can also be linked to a control means to provide special animation effects for the light—cycling the colour, pattern and timing of various strips.

The glass panels can be used for a number of different installation techniques such as vertical and horizontal glazing (single or double) curved glazing, glass corners, wind tankers, horizontal glazing, roof glazing and window casements.

Due to its flat profile, the electroluminescent film can be incorporated into existing profiled glass systems without interfering with the existing structure. All that is required is a slight modification to the upper plastic inserts to incorporate wiring connectors for a wiring loom; the addition of protection grommets attached to the aluminium frame to protect the power cable; and a mounting frame for the inverter.

Thus the present invention provides for the creation of distinctive light effects which can be enhanced by using sand blasted glass giving a near constant wash of light across the glass systems' compartments. It is also possible to use a clear glass structure to highlight the internal structure.

The invention is not limited to the described embodiment. The limitations of the invention are set out in the attached claims. Various improvements and embodiments can be made to the above without the parting from the scope of the invention.

The invention claimed is:

1. A transparent or translucent wall comprising;

an outward facing transparent or translucent U-shaped channel member having two parallel transversely spaced sides, namely a first side flange and a second side flange, interconnected by a first bottom element, said first side flange comprising a first side flange inner surface, said second side flange comprising a second side flange inner surface;

an inward facing transparent or translucent U-shaped channel member having two parallel transversely spaced sides, namely a third side flange and a fourth side flange, interconnected by a second bottom element, said third side flange comprising a third side flange inner surface, said fourth side flange comprising a fourth side flange inner surface, said inward facing channel member configured to interlock with said outward facing channel member, said interlocked inward facing channel member and said outward facing channel member defining an enclosed space;

a substantially U-shaped frame member having an inner channel, wherein the frame member is adapted to receive an interlocked inward facing channel member and an outward facing channel member; and an illuminator within said enclosed space, said illuminator disposed on at least one of said U-shaped channel member inner surfaces, wherein the illuminator directs light to pass through said enclosed space, wherein at least one of said transparent or translucent U-shaped channel members comprises a part of a face of said wall.

2. The wall of claim 1, wherein the wall is fabricated from at least one of glass and plastic material.

3. The wall of claim 1, comprising a plurality of outward facing channel members placed side-by-side and a plurality of inward facing channel members interlocked with said plurality of outward facing channel members, wherein the plurality of interlocked outward facing channel members and inward facing channel members are nested within the inner channel of the frame member.

4. The wall of claim 3, further comprising at least one of an upper housing member and a lower housing member for receiving the plurality of nested inward facing channel members and outward facing channel members.

5. The wall of claim 4, wherein at least one of said upper housing member and said lower housing member comprises a power connector for the illuminator.

6. The wall of claim 4, wherein the frame member is configured to receive the upper and lower housing members and a wall structure.

7. The wall of claim 6, wherein the wall structure comprises a hollow panel.

8. The wall of claim 1, wherein the illuminator comprises one or more light emitting diodes.

9. The wall of claim 1, wherein the illuminator comprises an electroluminescent strip.

10. The wall of claim 9, wherein the electroluminescent strip is adhesively bonded to the side flange of at least one of the outward facing channel member or inward facing channel member.

11. The wall of claim 9, wherein the electroluminescent strip has a split electrode structure.

12. The wall of claim 9, wherein the electroluminescent strip has a parallel electrode structure.

13. The wall of claim 1, wherein a DC-AC inverter is provided to power the illuminator.

14. The wall of claim 1, wherein the inward facing channel member and the outward facing channel member are U-shaped.

15. A transparent or translucent wall component comprising:

at least two transparent or translucent U-shaped channel members, said U-shaped channel members each having two parallel transversely spaced sides, namely a first side flange and a second side flange, interconnected by a first bottom element;

an outer frame member configured to house the at least two transparent or translucent U-shaped channel members; and an illuminator disposed on an inner edge of at least one of said side flanges, wherein the illuminator directs light through an internal space defined by the at least two transparent or translucent U-shaped channel members, wherein at least one of said transparent or translucent U-shaped channel members comprises a part of a face of said wall.

16. The wall component of claim 15, wherein the wall component is fabricated from a glass or plastic material.

17. The wall component of claim 15, wherein the illuminator comprises one or more light emitting diodes.

18. The wall component of claim 15, wherein the illuminator comprises an electroluminescent strip.

19. The wall component of claim 18, wherein the electroluminescent strip is adhesively bonded to at least one of the first and second side flanges of at least one of said transparent or translucent U-shaped channel members.

20. The wall component of claim 18, wherein the electroluminescent strip has a split electrode structure.

21. The wall component of claim 18, wherein the electroluminescent strip has a parallel electrode structure.

22. A building comprising:

a wall having an outward facing transparent or translucent U-shaped channel member having two parallel transversely spaced sides, namely a first side flange and a second side flange, interconnected by a first bottom element and an inward facing U-shaped channel member having two parallel transversely spaced sides, namely a third side flange and a fourth side flange, interconnected by a second bottom element, said inward facing U-shaped channel member interlocked with said outward facing transparent or translucent U-shaped channel member, wherein at least one of said transparent or translucent U-shaped channel members comprises a part of a face of said wall;

a housing member;

a substantially U-shaped frame member, wherein the U-shaped frame member is adapted to engage the housing member, the interlocked inward facing U-shaped channel member, and the outward facing transparent or translucent U-shaped channel member; and an illuminator disposed on at least one of said side flanges, said illuminator for directing light through a space defined by the interlocked U-shaped channel members.

23. The building of claim 22, wherein the illuminator comprises an electroluminescent strip.

24. The building of claim 23, wherein the wall component is fabricated from a glass or plastic material.

25. A building comprising:

a wall component comprising at least two transparent or translucent U-shaped channel members, said channel members each having two parallel transversely spaced sides, namely a first side flange and a second side flange, interconnected by a first bottom element, wherein at least two of said U-shaped channel members are interlocked with one another, defining an internal space therebetween, wherein at least one of said transparent or translucent U-shaped channel members comprises a part of a face of said wall;

an outer frame member adapted to receive the at least two transparent or translucent U-shaped channel members; and an illuminator, wherein the illuminator is disposed on at least one of said side flanges to cause light to travel through said internal space.

26. The building of claim 25, wherein the illuminator comprises an electroluminescent strip.

* * * * *

UNITED STATES PATENT AND TRADEMARK OFFICE

CERTIFICATE OF CORRECTION

PATENT NO. : 8,388,210 B2
APPLICATION NO. : 12/278793
DATED : March 5, 2013
INVENTOR(S) : John Paterson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 355 days.

Signed and Sealed this
First Day of September, 2015

Michelle K. Lee

Michelle K. Lee
*Director of the United States Patent and Trademark Office*